US012484691B1

(12) United States Patent
Kuo et al.

(10) Patent No.: US 12,484,691 B1
(45) Date of Patent: Dec. 2, 2025

(54) TOOTHPASTE-DISPENSING TOOTHBRUSH WITH A REPLACEABLE BRUSH HEAD

(71) Applicant: Youti Kuo, Penfield, NY (US)

(72) Inventors: Youti Kuo, Penfield, NY (US); Shau-San Wu, New Taipei (TW)

(73) Assignee: Youti Kuo, Penfield, NY (US)

( * ) Notice: Subject to any disclaimer, the term of this patent is extended or adjusted under 35 U.S.C. 154(b) by 0 days.

(21) Appl. No.: 19/171,497

(22) Filed: Apr. 7, 2025

Related U.S. Application Data

(60) Provisional application No. 63/654,004, filed on May 30, 2024.

(51) Int. Cl.
*A46B 11/00* (2006.01)

(52) U.S. Cl.
CPC ... *A46B 11/0055* (2013.01); *A46B 2200/1066* (2013.01)

(58) Field of Classification Search
CPC ..... A46B 7/04; A46B 7/042; A46B 7/044; A46B 2200/1066
See application file for complete search history.

(56) References Cited

U.S. PATENT DOCUMENTS 4,362,174 A * 12/1982 Baker ..... A46B 17/04 15/176.1
5,546,624 A * 8/1996 Bock ..... A46B 7/04 433/119
5,906,027 A * 5/1999 Barous ..... A46B 7/04 16/114.1
6,237,183 B1 * 5/2001 Fischer ..... A46B 7/04 15/176.1
8,448,287 B2 * 5/2013 Ponzini ..... A61C 17/222 15/176.1
8,647,007 B2 * 2/2014 Kuo ..... A46B 11/0062 401/290

* cited by examiner

*Primary Examiner* — David P Angwin
*Assistant Examiner* — Bradley S Oliver
(74) *Attorney, Agent, or Firm* — CKC & Partners Co., LLC

(57) ABSTRACT

A toothpaste-dispensing toothbrush includes a replaceable brush head, a pump head, a truncated dispensing platform attached with a spout, and a handle containing toothpaste. The brush head has a through hole and a stepped backside mating with the truncated dispensing platform by a set of latch mechanisms. The detachment of the brush head requires two steps by using two hands to rotate the brush head then push it off from the dispensing platform. The brush head is provided with an extended lever segment having a latch notch and the truncated dispensing platform has an extended neck portion having a neck post for engaging with the lever notch for additional locking. The stepped backside enables the brush head to brush back teeth with comfort. The applications of the replaceable brush head to a manual toothbrush and a toothpaste-dispensing electric toothbrush are provided.

3 Claims, 8 Drawing Sheets

TOOTHPASTE-DISPENSING TOOTHBRUSH WITH A REPLACEABLE BRUSH HEAD

CROSS-REFERENCE TO RELATED APPLICATION

This application claims priority to U.S. Provisional Application Ser. No. 63/654,004, filed May 30, 2024, which is herein incorporated by reference in its entirety.

BACKGROUND

Field of Invention

The present disclosure relates to replaceable brush heads used in a toothpaste-dispensing toothbrush, an electric toothbrush and a conventional manual toothbrush. More specifically, the present disclosure relates to locking mechanisms for fastening a replaceable brush head on a supporting platform extended from a toothbrush handle.

Description of Related Art

There is a growing need to minimize toothbrush waste for the environment. The most effective means is to have a toothbrush having a replaceable brush head with minimal replacement part for minimal disposal after use. In fact, toothbrushes are recommended to be replaced frequently because the bristles typically become frayed and worn with use, resulting in a decrease in cleaning effectiveness. Toothbrushes have handles that are generally formed of a relatively durable material that lasts longer than the brushing bristles.

For example, U.S. Pat. No. 8,448,287 by Ponzini, et al. describes a replaceable brush head for a toothbrush and a power toothbrush. The described replaceable brush head does not have a stepped backside having a bottom interface and the toothbrush main unit is not a truncated support platform with a top support interface to match with the stepped backside of the brush head. Therefore, the combined thickness of the top end of the brush head and the toothbrush main unit is beyond a conventional manual toothbrush, too thick and not comfortable to brush back teeth. Furthermore, the extension of the brush head does not have a latch notch on one side to engage with a latch post on the toothbrush unit to endure intimate contact between the brush head and the toothbrush unit to prevent seepage of water between the two parts.

SUMMARY

A toothpaste-dispensing toothbrush of the present invention includes a pump head, a truncated dispensing platform attached with a spout, a handle cartridge containing a dentifrice material and a replaceable brush head. The dentifrice material is dispensed to the top of the brush head by pressing on an actuator on the pump head. The replaceable brush head has a base having a through hole and a front side attached with bristles and a stepped backside mating with the truncated dispensing platform by a set of latch mechanism that enables the mounting and the separation of the brush head on and off from the truncated dispensing platform with rotational motions with the spout as the center of rotation.

The truncated dispensing platform has a top support interface, and a front side having a stepped latch groove. The stepped backside of the brush head has an elevated upper portion with a bottom interface, and a lower portion having a stepped latch post for locking with the stepped latch groove. The interfaces between the brush head and the truncated dispensing platform are of circular arc shape for rotational sliding contact between the two parts.

To ensure additional fastening of the brush head intimate contact between the two parts, the brush head is provided with an extended lever segment at its bottom end and the truncated dispensing platform has an extended neck portion for additional fastening and ergonomic handling of the brush head for mounting and separation of the brush head. The lever segment has a second bottom interface with a lever notch on one side, and the neck portion of the truncated dispensing platform has a bottom support surface and a neck post, which engages with the lever notch for locking. Both the lever notch and the neck post are of stepped configurations. This notch locking mechanism provides an audible cue for proper alignment between the brush head and the truncated dispensing platform.

In addition, the above mentioned replaceable brush head with stepped backside configuration and locking mechanisms is applicable to a toothpaste-dispensing electric toothbrush, which has a truncated dispensing platform undergoing vibration motion. The locking mechanisms in the truncated dispensing platform are the same as that in the afore-mentioned toothpaste-dispensing toothbrush. Moreover, the replaceable brush head with stepped backside configuration and locking mechanisms is also applicable to a conventional manual toothbrush, which does not contain toothpaste. In such a manual toothbrush, the replaceable brush head has a short shaft instead of a through hole. The replaceable brush head also has a stepped backside with a bottom interface, a stepped latch post and an extended lever segment having a latch notch on one side. The truncated support platform of the toothbrush handle has a top support interface, a stepped latch groove and a neck portion having a latch post for locking with the brush head. Furthermore, the features as described for the replaceable brush head are provided for an independent replaceable brush head for use in a toothpaste-dispensing toothbrush, an electric toothpaste-dispensing toothbrush and a manual toothbrush.

DETAILED DESCRIPTION

Figure 1B:
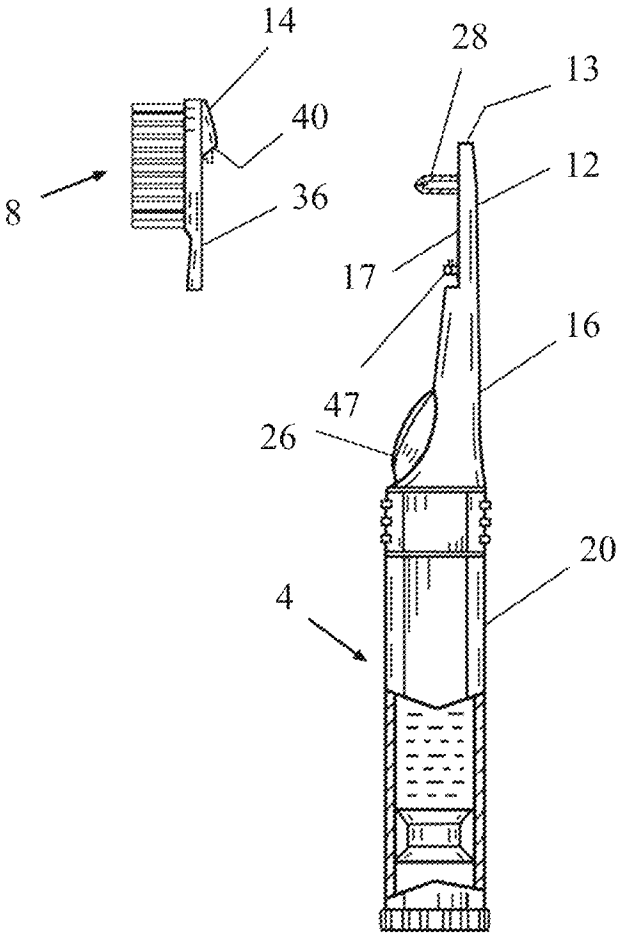
FIG. 1*b* is an operation schematic view of the toothpaste-dispensing toothbrush of FIG. 1*a*, which shows a replaceable brush head being detached from the toothpaste-dispensing toothbrush.

Throughout the following detailed descriptions, the same reference numerals refer to the same elements in all figures. Also, in the present invention, a toothpaste-dispensing toothbrush may be a manual toothpaste-dispensing toothbrush or an electric or powered toothpaste-dispensing toothbrush.

Toothpaste-Dispensing Manual Toothbrush

The structure and the function of a manual toothpaste-dispensing toothbrush having a replaceable brush head of the present invention are described in detail as follows. A manual toothpaste-dispensing toothbrush includes a replaceable brush head, a truncated dispensing platform extended from the pump head, and a handle containing toothpaste. FIG. 1*a* shows toothpaste-dispensing toothbrush 4 has replaceable brush head 8 having bristles 10 attached to truncated dispensing platform 12 extending from pump head 16, which is attached to handle 20 containing toothpaste 24. Handle 20 (e.g., handle cartridge) contains piston 32, and the piston moves toward pump head 16 under a vacuum force created when actuator 26 is released from a depressed position.

Figure 1A:
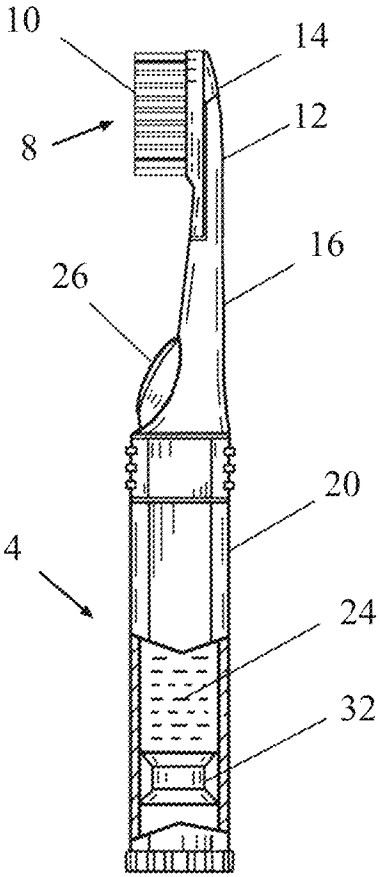
FIG. 1*a* is a side view of a toothpaste-dispensing toothbrush having a partial section view of a handle thereof according to one embodiment of the present disclosure.

FIG. 1*b* shows replaceable brush head 8 being detached from truncated dispensing platform 12 of toothpaste-dispensing toothbrush 4. In the present invention, a truncated dispensing platform is a toothbrush support platform that is attached with a replaceable brush head with the length of the support platform being short of the full length of the brush head.

Figure 1C:
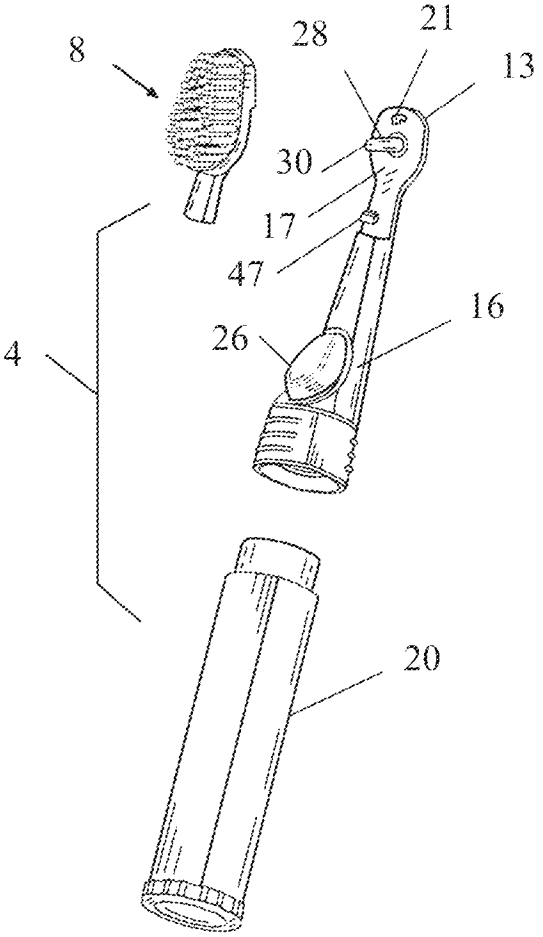
FIG. 1*c* is a preliminary disassembled view of the toothpaste-dispensing toothbrush of FIG. 1*a*.
Figure 4:
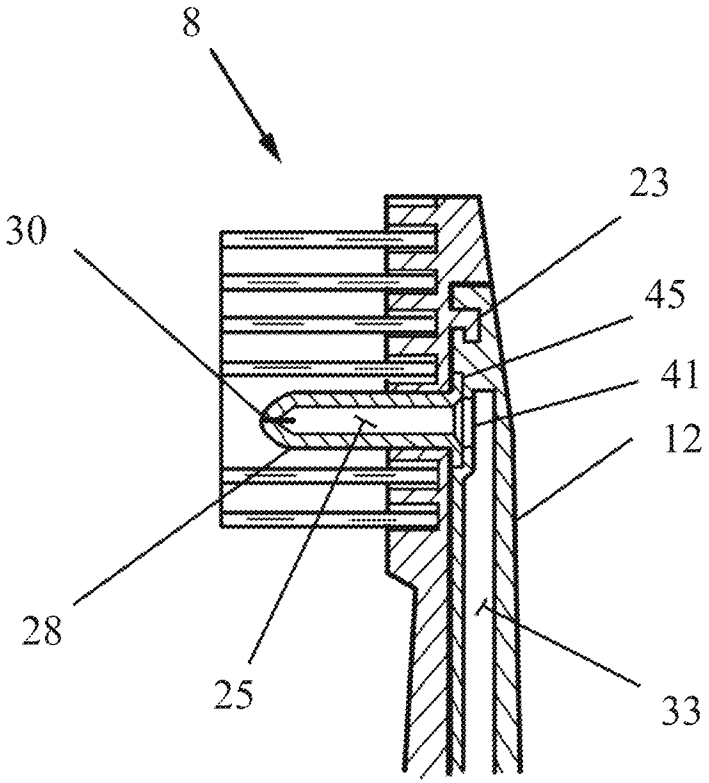
FIG. 4 is a longitudinal section view of a replaceable brush head engaged with a truncated dispensing platform.

As shown in FIG. 1*c*, truncated dispensing platform 12 has top support interface 13, a flow channel (shown as flow channel 33 in FIG. 4), front side 17 attached with latch recess 21 and spout 28 in flow communication with the flow channel (shown as flow channel 33 in FIG. 4). In the present invention, replaceable brush head 8 has stepped backside 14 and truncated support platform is situated below the stepped backside of brush head 8. Stepped backside 14 of brush head 8 has first bottom interface 40, and the truncated support platform has top support interface 13 mating with first bottom interface 40 of brush head 8. Also, in the present invention, a toothpaste-dispensing toothbrush may be a manual toothpaste-dispensing toothbrush or an electric or powered toothpaste-dispensing toothbrush.

Specifically, pump head 16 includes a pumping chamber attached with elastic actuator 26 and a one-way valve inside the pumping chamber. Truncated dispensing platform 12 includes a flow channel (shown as flow channel 33 in FIG. 4), with an outlet opening (shown as outlet opening 41 in FIG. 4) attached with slit spout 28. Spout 28 has slit 30 at its top end to open and allow exit of the toothpaste under a pumping force and the slit closes under a vacuum force when the actuator rebounds from the depressed position.

Figure 5B:
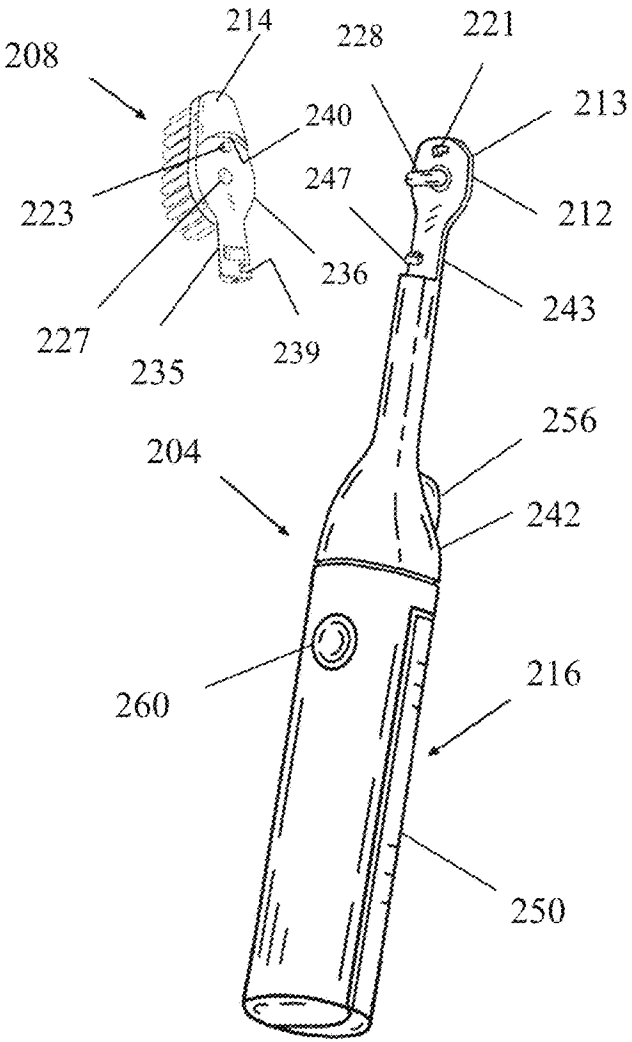
FIG. 5*b* is an operation schematic view of the electric pump toothbrush of FIG. 5*a*, which shows a replaceable brush head being detached from the electric pump toothbrush.
Figure 5A:
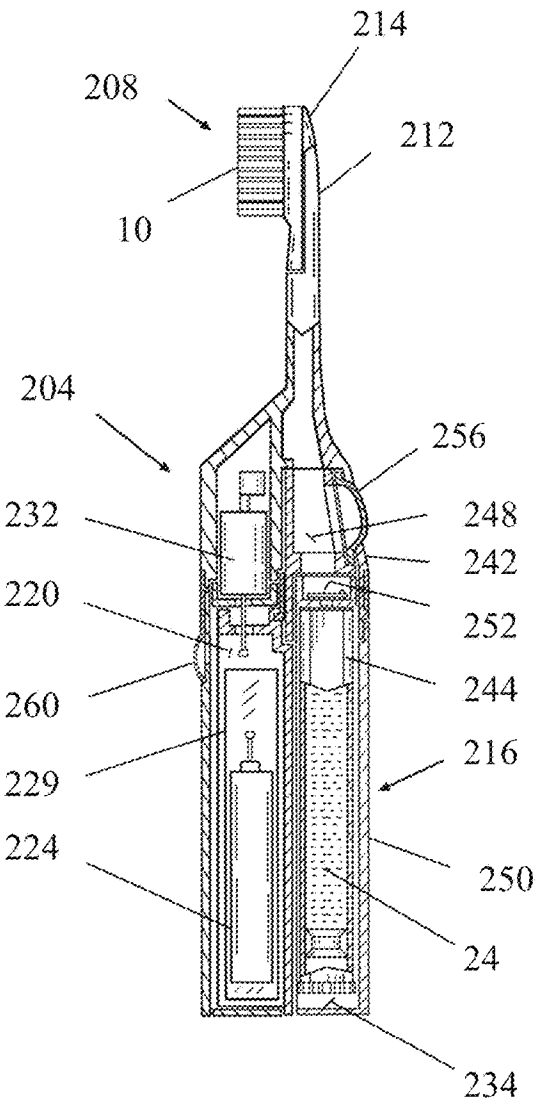
FIG. 5*a* is a longitudinal section view of an electric pump toothbrush according to one embodiment of the present disclosure.

Moreover, truncated dispensing platform 12 has stepped latch recess 21 on front side 17. The handle itself is a toothpaste cartridge or contains a toothpaste tube. As shown in FIG. 1*a*, handle 20 is a toothpaste cartridge containing piston 32. When actuator 26 is pressed down, toothpaste 24 is forced to exit from spout 28 to the top of the brush head. When the actuator is released from a depressed position a vacuum force created inside the pump head causes the piston to move forward to replenish the pump head with the toothpaste. The structure and the function of a toothpaste-dispensing toothbrush have been described in U.S. Pat. No. 8,647,007 by Kuo. And separately, a detailed structure of the pump head is given in a latter section describing a toothpaste-dispensing electric toothbrush as shown in FIG. 5*a* and FIG. 5*b*.

Figure 2B:
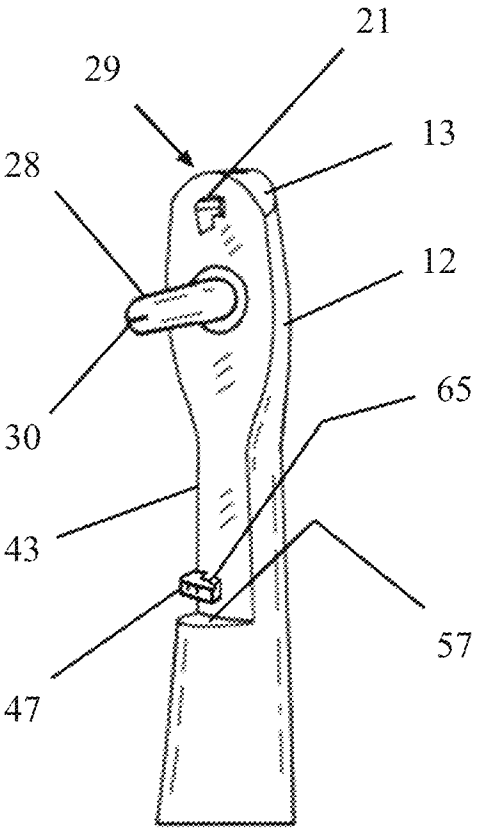
FIG. 2*b* is a perspective view of the truncated dispensing platform of FIG. 1*c*.
Figure 2A:
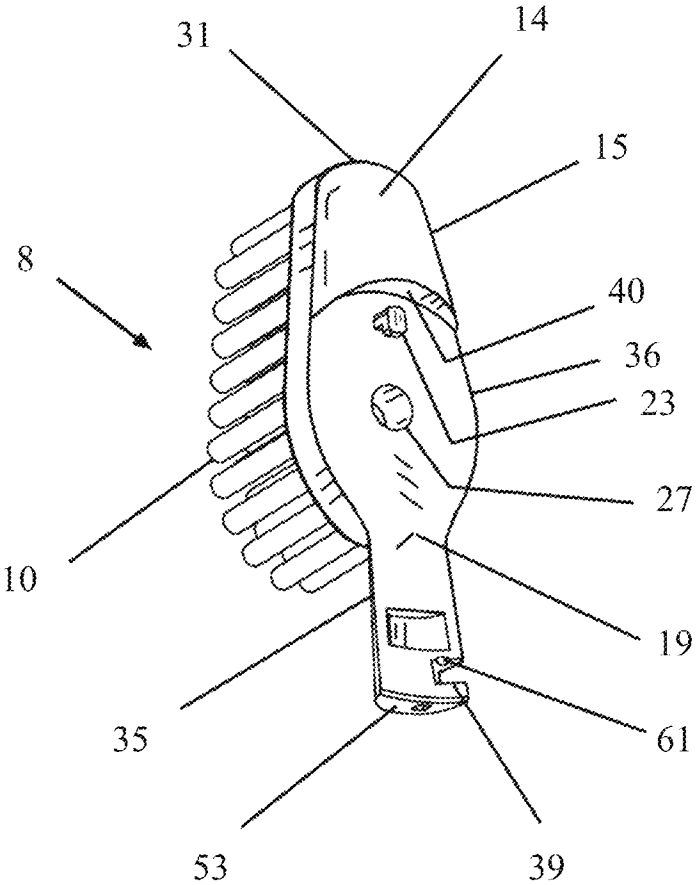
FIG. 2*a* is a perspective view of the replaceable brush head of FIG. 1*c* viewed from another aspect.

Also shown in FIGS. 2*a*, 2*b*, replaceable brush head 8 has base 36 with a front side attached with bristles 10, stepped backside 14 having elevated upper portion 15 with first bottom interface 40, and lower portion 19 having first latch element 23, shown as stepped latch post as an exemplary configuration, and through hole 27 for engaging with spout 28. First bottom interface 40 is for mating with top support interface 13 of truncated dispenser platform 12. Truncated dispenser platform 12 has first latch counter element, shown as stepped latch recess 21 as an exemplary configuration, is to engage with first latch element 23 for locking the brush head on the truncated dispensing platform. The stepped backside configuration has the advantage that it enables the thickness of lead edge 31 to be the same as that of a conventional manual toothbrush for brushing the back teeth with comfort. It also enables lead edge 29 of the truncated support platform to have sufficient thickness to avoid potential warpage in an injection molding manufacturing process. A warped support platform can cause a gap between the replaceable brush head and the warped support platform to have undesirable water seepage in the gap during teeth brushing.

In the present invention, the term latch element refers to one part of a latch mechanism and the term latch counter element refers to a counter part of the same latch mechanism that when the two parts are engaged, the latch mechanism is locked. Generally, either the latch element or the latch counter element is deflectable for in the action of engagement and disengagement or both are deflectable when in the action of engagement or disengagement.

In a preferred embodiment, first bottom interface 40 of brush head 8 and top support interface 13 of the truncated dispensing platform are of circular arcs with rotational axis at the center of spout 28, and that the brush head is detachable from the dispensing platform when the brush head is rotated away to disengage the stepped post from the stepped groove. Furthermore, brush head 8 has extended lever segment 35 having second bottom interface 53 at its end, and truncated dispensing platform 12 has bottom support surface 57 at the end of neck portion 43 to mate with second bottom interface 53.

Figure 3C:
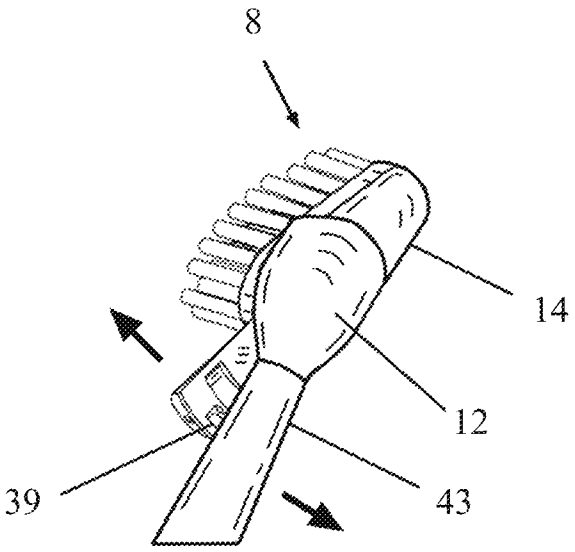
FIG. 3*c* is an operation schematic views of the brush head of FIG. 1*c* being rotated about the spout for being unlocked on the truncated dispensing platform.
Figure 3B:
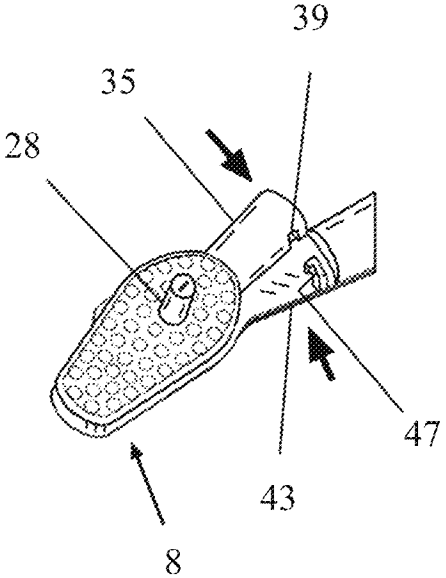
FIG. 3*b* is an operation schematic view of the brush head of FIG. 1*c* being rotated about the spout for being locked on the truncated dispensing platform after inserting the spout into the through hole of the brush head.
Figure 3A:
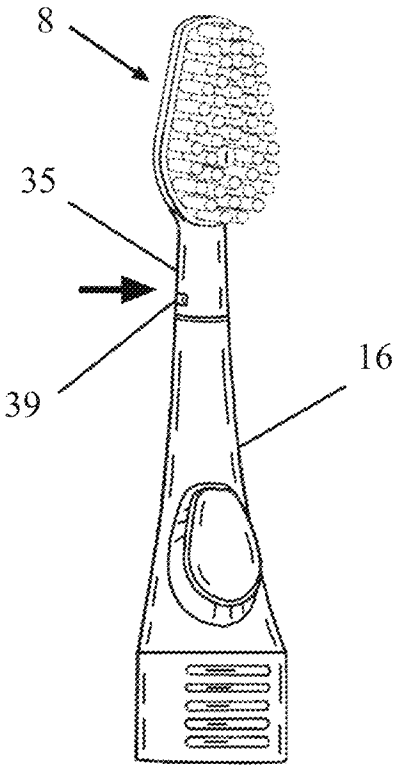
FIG. 3*a* is a perspective view showing the brush head of FIG. 1*c* mounted on the truncated dispensing platform extended from pump head.

FIG. 3*a* shows brush head 8 of FIG. 1*c* mounted on the truncated dispensing platform extended from pump head 16 with extended lever segment 35 having second latch element, shown as stepped latch notch 39, on one side. The lever segment makes it easier for fingers to rotate the brush head to engage or move away from the truncated dispensing platform. To accommodate the lever segment, a shown in FIG. 3*b*, truncated dispensing platform has neck portion 43 having second latch counter element, shown as stepped latch post 47 to engage with stepped latch notch 39. FIG. 3*b* also shows the front side of the brush head that, after inserting spout 28 in the through hole, rotating the brush head toward the truncated dispensing platform to lock stepped latch notch 39 with stepped neck post 47. FIG. 3*c* shows backside 14 of brush head 8 with lever segment 35, shown in FIG. 3*b*, rotated away from neck portion 43 on truncated dispensing platform 12. To ensure accurate alignment, latch notch 39 has a small indented surface to mate with a small protrusion in neck post 47 of the brush head to a locking position. At the moment of the locking engagement, a click sound is created as a feedback signal that the brush head is securely mounted on the truncated dispensing platform. The detachment of the brush head requires two steps by using two hands to rotate the brush head then push it off from the dispensing platform.

In one embodiment of the present invention, a self-closing slit-spout is fastened to the outlet opening in the truncated dispensing platform. FIG. 4 shows the attachment of self-closing slit spout 28 with flow channel 25 on outlet opening 41 in truncated dispensing platform 12, which has flow channel 33 in communication with the pumping chamber inside pump head 16 (shown in FIG. 1*a*) of toothpaste-dispensing toothbrush 4. A preferred method of attachment is by adhesive bonding. Base 45 of spout 28 may be a non-circular shape to match with a mating non-circular shape recess in the truncated dispensing platform to prevent dislodging of the spout when the replaceable brush head is rotated to mount on or to detach from the truncated dispensing platform.

Toothpaste-Dispensing Electric Toothbrush

Similarly, the various fastening configurations as described previously are applicable to a replaceable brush head of a toothpaste-dispensing electric toothbrush, or electric pump toothbrush, interchangeably. The toothpaste-dispensing electric toothbrush, or electric pump toothbrush, has a handle containing a power source and a motor driving a truncated dispensing platform and a replaceable brush head in vibrating motion for brushing. FIG. 5*a* shows electric pump toothbrush 204 having replaceable brush head 208 and handle 216.

Brush head 208 has a stepped backside 214 mounted on truncated vibratory support platform 212, which is extended from handle 216. Handle 216 includes electric compartment 220 having power source 224, circuitry 229, and motor 232 with a vibrating mechanism, and dispensing compartment 234 having a pump head 242 and refillable toothpaste cartridge 244 and cover 250. The toothpaste cartridge may be installed and removed for refilling by opening cover 250. Pump head 242 includes pumping chamber 248, one-way valve 252 and actuator 256. When the actuator is depressed, the toothpaste in the pumping chamber is forced to exit from the spout to the top of the replaceable brush head. When the actuator is released from the depressed position, the vacuum force created draws toothpaste 24 from the toothpaste cartridge to replenish the pumping chamber and at the same time force slit spout 228 (shown in FIG. 5*b*) to close. The power source may be a battery or a rechargeable battery, and the motor itself may be a vibrator. The vibrator or a biased drive mechanism imparts vibration motion in both the truncated dispensing platform and the brush head. Switch 260 is for actuating the vibration of the brush head.

FIG. 5*b* shows replaceable brush head 208 detached from truncated support platform 212. Brush head 208 has through hole 227 in base 236 and truncated support platform 212 has spout 228, which engages with through hole 227. Furthermore, brush head 208 has latch post 223 and lever notch 239 in lever segment 235, which have the same features and functions of latch post 23 and lever notch 39 as described in FIG. 2*a* for toothpaste-dispensing manual toothbrush 4. Truncated support platform 212 has top support interface 213 for mating with first bottom interface 240 and latch recess 221 and neck post 247 in neck 243 for engaging with latch post 223 and lever notch 239 of brush head 208, respectively. The features and functions of latch recess 221 and neck post 247 are the same as that of latch recess 21 and neck post 47 described previously in FIG. 2*b*.

Manual Toothbrush

Figure 6B:
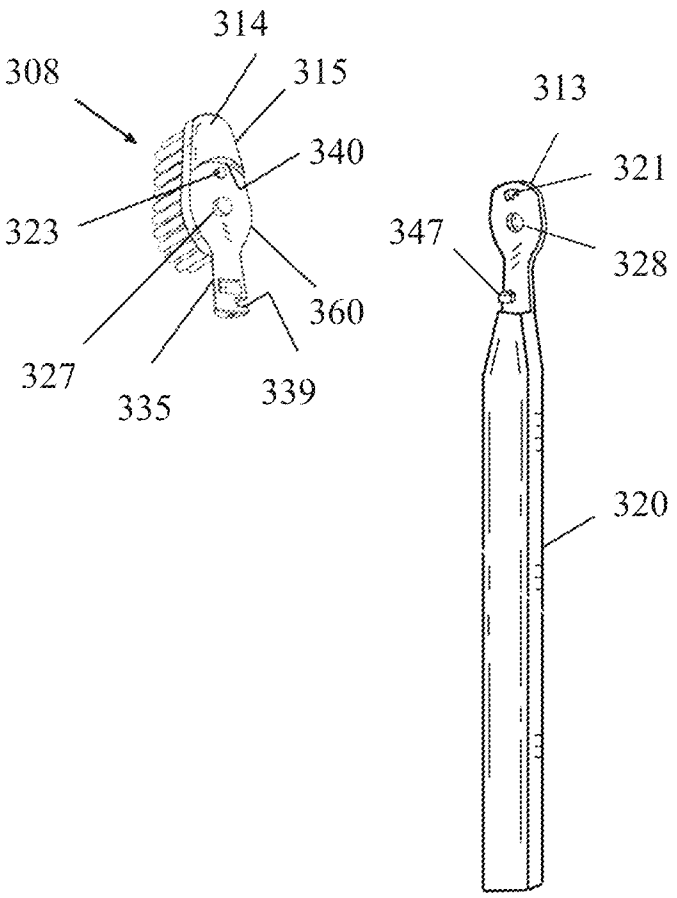
FIG. 6*b* is an operation schematic view of the manual toothbrush of FIG. 6*a*, which shows a replaceable brush head being detached from the manual toothbrush.
Figure 6A:
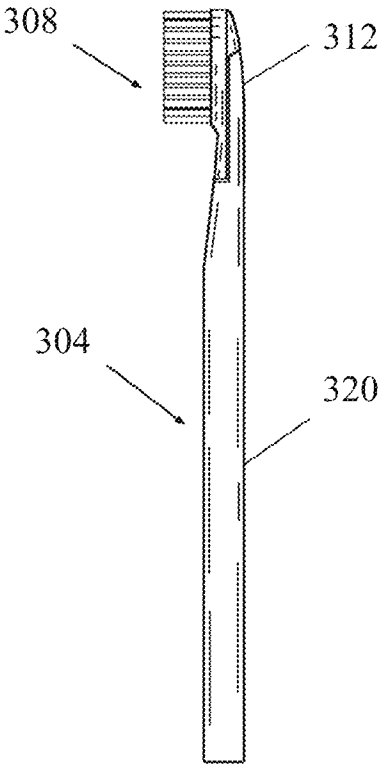
FIG. 6*a* is a longitudinal section view of a manual toothbrush according to one embodiment of the present disclosure.

The above various fastening configurations are applicable to a replaceable brush head for a conventional manual toothbrush or toothbrush, whose handle does not contain toothpaste. Here, FIG. 6*a* shows toothbrush 304 having replaceable brush head 308 mounted on truncated support platform 312 extended from handle 320. As shown in FIG. 6*b*, stepped backside 314 has elevated upper portion 315 with first bottom interface 340 of a circular arc shape. And FIG. 6*b* shows replaceable brush head 308 detached from truncated support platform 312. Brush head 308 has short shaft 327 in base 360 and truncated support platform 312 has circular recess 328, which engages with short shaft 327. Brush head 308 has latch post 323 and lever notch 339, which have the same features and functions of latch post 23 and lever notch 39 as described in FIG. 2*a* for toothpaste-dispensing manual toothbrush 4. Also, as shown in FIGS. 6*a*, 6*b*, truncated support platform 312 has top support interface 313 for mating with first bottom interface 340. Latch recess 321 and neck post 347, which have the same features and functions as latch recess 21 and neck post 47 described previously in FIG. 2*b*, are for engaging with latch post 323 and lever notch 339 of the brush head, respectively.

Replaceable Brush Head

Figure 7B:
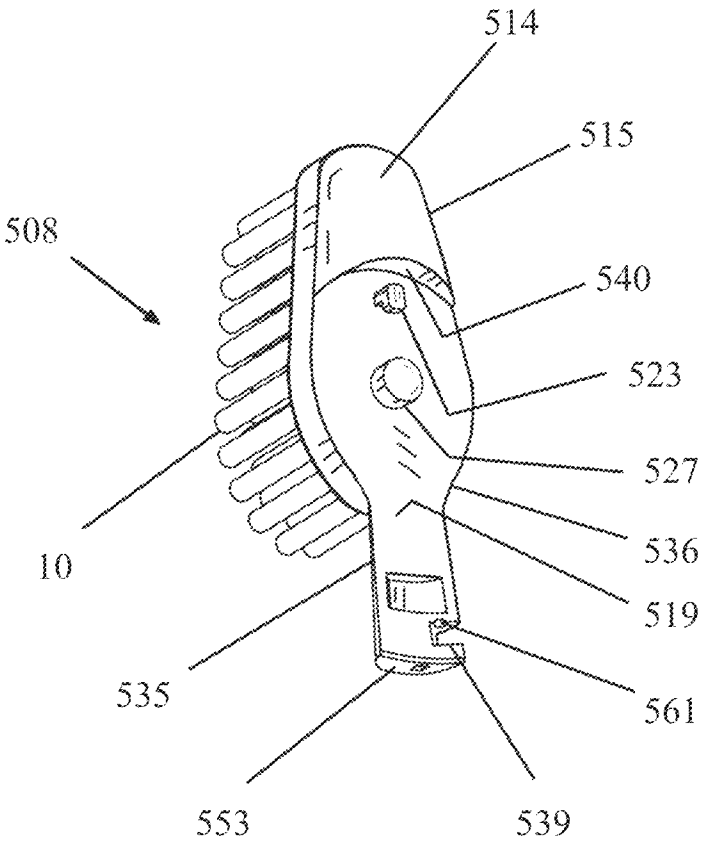
FIG. 7*b* is a perspective view of a replaceable brush head according to one embodiment of the present disclosure.
Figure 7A:
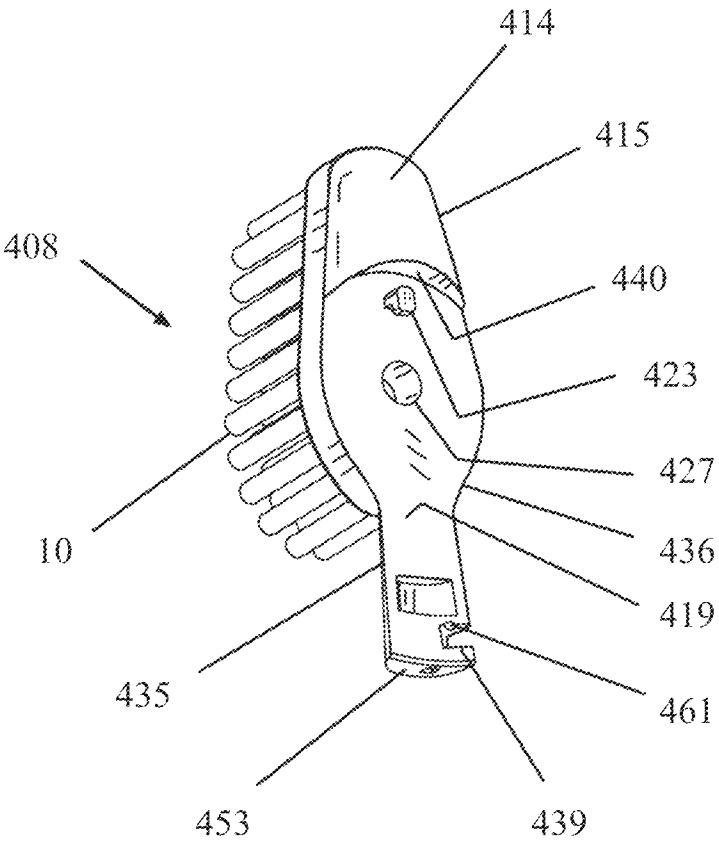
FIG. 7*a* is a perspective view of a replaceable brush head according to one embodiment of the present disclosure.

As an embodiment of the present invention, as shown in FIG. 7*a* independent replaceable brush 408 head comprises base 436 having a front side attached with bristles and stepped backside 414 having elevated upper portion 415 with first bottom interface 440 of a circular arc shape and lower portion 419 having through hole 427 and latch post 423. Lower portion 419 has lever segment 435 having second bottom interface 453 and latch notch 439. Through hole 427 and latch post 423 rotationally engage with a top support interface, a spout and a latch groove in a truncated dispensing platform of a toothpaste dispensing toothbrush for locking and detaching the brush head from the truncated dispensing platform.

FIG. 7*b* shows that another independent replaceable brush head 508 comprises base 536 having a front side attached with bristles and stepped backside 514 having elevated upper portion 515 with first bottom interface 540 of a circular shape, short shaft 527, latch post 523, and first bottom interface 540. Lower portion 519 has lever segment 535 having second bottom interface 553 and latch notch 539. Short shaft 527 and latch post 523 rotationally engage with a top support interface, a circular recess and a latch groove in a truncated support platform of a manual toothbrush for locking and detaching brush head 508 from the truncated support platform. In the exemplary embodiment of FIGS. 7*a* and 7*b*, the latch posts are of a stepped configuration and the latch grooves are of a stepped configuration. Additionally the lower portion has a lever segment having a second bottom interface and a latch notch for engaging with a corresponding bottom support interface and a neck latch post in the truncated toothbrush support platform.

The invention has been described in detail with reference to preferred embodiments thereof. However, it is understood that variations and modifications can be effected within the spirit and scope of the invention.

What is claimed is:

1. A toothbrush having a replaceable brush head, comprising:

i. a handle with a truncated support platform, said truncated support platform having a first latch element, a top support interface; and a neck portion having a neck latch; and ii. a replaceable brush head having a front side attached with bristles, and a stepped backside having an elevated upper portion with a first bottom interface mating with the top support interface of said truncated support platform and a lower portion having a first latch element engaging with a first latch counter element of said truncated support platform, and a lever segment including a latch notch on one side engaging with said neck latch of said truncated support platform.

2. A replaceable brush head comprising a base having a front side attached with bristles and a stepped backside, said stepped backside having an elevated upper portion with a first bottom interface of a circular arc shape and a lower portion having a circular element with a latch post and a lever segment having a neck notch, said first bottom interface, said circular element and said latch post rotationally engaged with a corresponding top support interface, a circular counter element, a latch counter groove, and a neck latch post in a truncated toothbrush support platform for locking and detaching said replaceable brush head from said truncated toothbrush support platform.

3. The replaceable brush head of claim 2, wherein said latch post is of a stepped configuration, and said latch counter groove in said truncated toothbrush is of a stepped configuration.

* * * * *